US009275843B2

(12) United States Patent
Furuhashi et al.

(10) Patent No.: US 9,275,843 B2
(45) Date of Patent: Mar. 1, 2016

(54) TIME-OF-FLIGHT MASS SPECTROMETER

(75) Inventors: Osamu Furuhashi, Uji (JP); Junichi Taniguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 14/007,387

(22) PCT Filed: Feb. 6, 2012

(86) PCT No.: PCT/JP2012/052593

§ 371 (c)(1),
(2), (4) Date: Sep. 25, 2013

(87) PCT Pub. No.: WO2012/132550

PCT Pub. Date: Oct. 4, 2012

(65) Prior Publication Data

US 2014/0008531 A1 Jan. 9, 2014

(30) Foreign Application Priority Data

Mar. 25, 2011 (JP) ..... 2011-066999

(51) Int. Cl.
*H01J 49/06* (2006.01)
*H01J 49/40* (2006.01)

(52) U.S. Cl.
CPC ..... *H01J 49/067* (2013.01); *H01J 49/401* (2013.01)

(58) Field of Classification Search
CPC ..... H01J 49/06
USPC ..... 250/287
See application file for complete search history.

(56) References Cited

U.S. PATENT DOCUMENTS 7,176,455 B1 * 2/2007 Whitehouse ..... H01J 49/063 250/281
7,683,314 B2 * 3/2010 Green ..... H01J 49/06 250/281

(Continued)

FOREIGN PATENT DOCUMENTS

JP 2003-123685 A 4/2003

OTHER PUBLICATIONS

Sise et al, "Multi-element cylindrical electrostatic lens systems for focusing and controlling charged particles", Nuclear Instruments and Methods in Physics Research A 554 (2005) pp. 114-131.*

(Continued)

*Primary Examiner* — Phillip A Johnston
(74) *Attorney, Agent, or Firm* — Morgan, Lewis & Bockius LLP

(57) ABSTRACT

An electrostatic lens (3), including five cylindrical electrodes (31-35) arrayed along an ion-optical axis (C) and an aperture plate (38) located on a common focal plane of two virtual convex lenses (L1 and L2) formed under an afocal condition, is used as an ion-injecting optical system for sending ions into an orthogonal acceleration unit. The diameter of a restriction aperture (39) formed in the aperture plate (38) determines the angular spread of an exit ion beam. When voltages for making the electrostatic lens (3) function as an afocal system are set, a measurement with high mass-resolving power can be performed at a slight sacrifice of the sensitivity. When voltages for making the lens function as a non-afocal system having the highest ion-passage efficiency are set, a measurement with high sensitivity can be performed at a slight sacrifice of the resolving power.

14 Claims, 10 Drawing Sheets

(56) References Cited

U.S. PATENT DOCUMENTS

| | | | | |
|---|---|---|---|---|
| 7,947,951 | B2 * | 5/2011 | Khursheed | H01J 37/05 250/305 |
| 8,921,803 | B2 * | 12/2014 | Welkie | H01J 37/12 250/288 |

OTHER PUBLICATIONS

M. Guilhaus et al., "Orthogonal acceleration time-of-flight mass spectrometry", Mass Spectrometry. Reviews, 19:65-107, (2000).

E..A. Granneman et al., "Transport, dispersion and detection of electrons, ions and neutrals", Handbook on Synchrotron Radiation, vol. 1, pp. 2, 10 and 40, (1979).

D W O Heddle, "An afocal electrostatic lens", Journal of Physics E: Scientific Instruments, 4:981-983, (1971).

International Search Report (English trans.) mailed on May 1, 2012 for International Patent Application No. PCT/JP2012/052593 (2 pgs.).

Written Opinion (English trans.) mailed on May 1, 2012 for International Patent Application No. PCT/JP2012/052593 (4 pgs.).

Extended European Search Report received for European Patent Application No. 12765023.2 mailed on Feb. 6, 2015, 7 pages.

Examination Report Received for Chinese Patent Application No. 201280015004.6, mailed on Apr. 28, 2015, 6 pages. (1 page of English Translation and 5 pages of Official Copy).

* cited by examiner (a)

(b)

TIME-OF-FLIGHT MASS SPECTROMETER

RELATED APPLICATIONS

This application is the U.S. national stage application of International (PCT) Patent Application Serial No. PCT/JP2012/052593, filed Feb. 6, 2012, which claims the benefit of JP Application No. 2011-066999, filed Mar. 25, 2011. The entire disclosure of each of these applications is hereby incorporated by reference.

TECHNICAL FIELD

The present invention relates to a time-of-flight mass spectrometer, and more specifically to an ion-injecting optical system for injecting ions into an orthogonal acceleration unit of an orthogonal acceleration time-of-flight mass spectrometer (which may also be called a vertical acceleration time-of-flight mass spectrometer).

BACKGROUND ART

In a time-of-flight mass spectrometer (which is hereinafter abbreviated as "TOFMS"), a specific amount of kinetic energy is imparted to ions originating from sample components to make the ions fly over a specific length of space. The period of time required for the flight is measured for each ion, and the mass-to-charge ratio of each ion is determined from the time of flight of that ion. Therefore, one of the major causes of a decrease in the mass-resolving power in the TOFMS is a variation in the initial energy of the ions. To address this problem, a reflectron-type TOFMS includes a reflectron having the function of correcting the difference in the kinetic energy of the ions. Though no detailed description will hereinafter be made, a commonly known, dual-stage reflectron is capable of up to the second-order energy focusing (i.e. the distribution of the time of flight can be corrected up to the second-order derivative of the energy). Therefore, even if there is a certain amount of variation in the kinetic energy of the ions, the reflectron can correct that variation and focus the ions within a certain range of time of flight, thus preventing the deterioration in the mass-resolving power.

Another cause of the deterioration in the mass-resolving power is the turn-around time which occurs in a system that captures ions in an ion trap or similar device and imparts an amount of acceleration energy to the captured ions to bring them into flight. When ions are accelerated in the time-of-flight analysis direction, an ion having a velocity component opposite to the time-of-flight analysis direction due to its initial energy consumes a certain amount of time to return to the starting point after departing from the starting point. This is the turn-around time. It corresponds to the time-of-flight difference between an ion having a forward velocity component with respect to the time-of-flight analysis direction and an ion having an opposite velocity component. Accordingly, in a broad sense, the turn-around time can also be regarded as a resultant of the variation in the initial energy of the ions. However, the error due to the turn-around time cannot be corrected by a reflectron. Therefore, how to reduce the influence of the turn-around time is an essential problem for the mass-resolving power of the TOFMS.

One technique for solving this problem is an orthogonal acceleration TOFMS in which ions are accelerated in a direction orthogonal to the incident direction of an ion beam and sent into a time-of-flight analysis space (for example, see Patent Document 1 or Non-Patent Document 1). FIG. 11 is a schematic configuration diagram of an orthogonal ion acceleration unit and an ion-injecting optical system located before that unit in an orthogonal acceleration TOFMS.

An orthogonal acceleration unit 4 includes a plate electrode 41 and a mesh electrode 42 having a large number of openings for allowing ions to pass through, and an ion-injecting optical system 300 including a beam-restricting mechanism consisting of two slit plates (or aperture plates) 301 and 302 separated by a predetermined gap L. In this figure, the initial direction of the ion beam entering the accelerating region between the electrodes 41 and 42 is the X direction, while the accelerating direction (i.e. the time-of-flight analysis direction) is the Z-direction orthogonal to the X-direction. When ions are injected from the beam-restricting mechanism into the orthogonal acceleration unit 4, the electrodes 41 and 42 are at the same potential (e.g. ground potential) and no electric field is present in the accelerating region. When an adequate amount of ions have been injected, a high-voltage pulse having the same polarity as the ions is applied to the plate electrode 41, whereby an accelerating electric field is created in the accelerating region, imparting a large amount of kinetic energy to the ions. As a result, the ions begin to fly, passing through the openings of the mesh electrode 42.

A time-of-flight distribution in the orthogonal acceleration unit 4 is hereinafter discussed.

An initial energy Ez of the ions in the time-of-flight analysis direction is given by $Ez=E\sin^2\alpha$, where E is the amount of energy of an ion beam entering the orthogonally accelerating region and $\alpha$ is the angle to the X axis of the beam. The higher the initial energy Ez is, the larger the time-of-flight distribution due to the aforementioned turn-around time is. To decrease the initial energy Ez, it is necessary to reduce the amount of energy E and the angle $\alpha$. The beam-restricting mechanism is aimed at limiting this angle $\alpha$ to a small value. In the example of FIG. 11, the angular spread of the beam is given by $\alpha=\tan^{-1}(h/L)$, where L is the gap between the two slit plates 301 and 302, and h is the aperture width of the slit plate 302. Therefore, it is possible to decrease the angle $\alpha$ of the ion beam and reduce the dispersion in the initial energy of the ions within an allowable range by appropriately setting the gap L and the aperture width h.

In a system described in Patent Document 1 and other documents, an electrostatic lens which is an aperture lens is provided between an ion trap and a beam-restricting mechanism in order to efficiently introduce ions released from the ion trap. Such a combination of the electrostatic lens in the form of an aperture lens and a beam-restricting mechanism consisting of a pair of slit plates have been widely used in practical systems.

However, the previously described conventional configuration has the following problem:

In the aforementioned beam-restricting mechanism, a considerable portion of the ion-beam flux collides with and is blocked by the slit plate. Therefore, the amount of ions actually used for the time-of-flight analysis is considerably smaller than the original amount, so that the measurement sensitivity inevitably deteriorates. To improve the measurement sensitivity, it is necessary to increase the aperture width h of the slit, which, however, increases the angle $\alpha$ of the beam and lowers the mass-resolving power. Thus, there is a trade-off between the mass-resolving power and the measurement sensitivity, and it is unavoidable to sacrifice the measurement sensitivity if a high level of mass-resolving power needs to be achieved.

In the aforementioned conventional configuration, the mass-resolving power is determined by the gap between the two slit plates and the aperture width of the slit. Therefore, for example, when a high-sensitivity measurement must be performed while allowing a slight deterioration of the mass-resolving power, it is necessary to perform a mechanical task, such as replacing the slit plates of the beam-restricting mechanism with the ones having a different aperture width or adjusting the gap of the slit plates. Such a task is cumbersome and time-consuming. Furthermore, a mechanism which allows such a mechanical adjustment or replacement has a problem in terms of reliability.

BACKGROUND ART DOCUMENT

Patent Document

Patent Document 1: JP-A 2003-123685

Non-Patent Document

Non-Patent Document 1: M. Guilhaus et al., "Orthogonal Acceleration Time-of-flight Mass Spectrometry", *Mass Spectrom. Rev.,* 19, 2000, pp. 65-107

Non-Patent Document 2: E. H. A. Granneman et al., "TRANSPORT, DISPERSION AND DETECTION OF ELECTRONS, IONS AND NEUTRALS", *Handbook on synchrotron radiation volume* 1

Non-Patent Document 3: D W O Heddle, "An afocal electrostatic lens", *Journal of Physics E: Scientific Instruments,* 4, 1971, pp. 981-983

SUMMARY OF THE INVENTION

Problem to be Solved by the Invention

The present invention has been developed to solve the previously described problems, and its primary objective is to provide an orthogonal acceleration time-of-flight mass spectrometer in which both high mass-resolving power and high measurement sensitivity can be achieved by reducing the angular spread of the ion beam, with only a minimal decrease in the beam strength, when sending ions into an orthogonal acceleration unit.

Another objective of the present invention is to provide an orthogonal acceleration time-of-flight mass spectrometer which can be easily switched between a measurement with emphasis placed on the mass-resolving power and a measurement with emphasis placed on the sensitivity according to the purpose of the analysis or other factors.

Means for Solving the Problems

As explained earlier, achieving high mass-resolving power requires reducing the angular distribution of the ions when the ions are sent into the orthogonal acceleration unit. Furthermore, it is also necessary to suppress the spatial distribution of the ions. Taking these requirements into account, the present inventors have conceived the idea of using, as the ion-injecting optical system for sending ions into the orthogonal acceleration unit, an afocal electrostatic lens provided with a restrictor placed at a common focal plane of the first and second virtual convex lenses in the electrostatic lens, which is a system proposed by Heddle (see Non Patent Documents 2 and 3).

That is to say, the present invention aimed at solving the previously described problem is an orthogonal acceleration time-of-flight mass spectrometer including an orthogonal acceleration unit for accelerating incident ions in a direction orthogonal to an incident axis of the ions and an ion-injecting optical system for sending the ions into the orthogonal acceleration unit, wherein the ion-injecting optical system includes:

a) an electrostatic lens composed of five or more cylindrical electrodes arranged along an ion-optical axis;

b) a voltage supplier for applying voltages to the respective cylindrical electrodes so that the electrostatic lens becomes an afocal system; and c) a restrictor having an aperture of a predetermined size on the ion-optical axis, the restrictor being located on a common focal plane of a first-stage virtual convex lens formed by a portion of the five or more cylindrical electrodes and a second-stage virtual convex lens formed by a portion of the five or more cylindrical electrodes under the condition that the voltages for making the electrostatic lens become an afocal system are applied from the voltage supplier.

Under the condition that the voltages for making the electrostatic lens become an afocal system are applied to the respective cylindrical electrodes, an ion beam injected parallel to the optical axis of the electrostatic lens passes through the optical axis on the common focal plane and exits parallel to the optical axis. On the other hand, an ion beam injected non-parallel to the optical axis passes through a point displaced from the optical axis on the common focal plane. Therefore, the angular spread of the exit ion beam depends on the aperture size of the restrictor. By contrast, the spatial spread of the exit ion beam depends on the focal distance of each of the two virtual convex lenses and other factors, and therefore, can be set independently of the angular spread of the exit ion beam. Thus, in the ion-injecting optical system of the time-of-flight mass spectrometer according to the present invention, it is possible to restrict the angular spread of the exit ion beam with almost no influence on the spatial spread of the ion beam. Furthermore, in the ion-injecting optical system of the time-of-flight mass spectrometer according to the present invention, the portion of ion beam which will be blocked by the slits in the case of the conventional beam-restricting mechanism using a combination of two slits can be effectively used (i.e. that portion can also be reflected in the exit ion beam). Therefore, it is possible to improve the mass-resolving power while maintaining the measurement sensitivity to a certain degree.

As described previously, in the case where the electrostatic lens is an afocal system, a beam parallel to the optical axis of the electrostatic lens will exit in the parallel direction. However, this situation does not mean that the amount of ions passing through the aperture of the restrictor located on the common focal plane is maximized. In general, it is when the electrostatic lens is a non-afocal system that the efficiency of the ions' passage through the electrostatic lens is maximized. However, in this situation, the angular spread of the exit ion beam will not be at a minimum.

Accordingly, in one preferable mode of the time-of-flight mass spectrometer according to the present invention, the voltage supplier can apply voltages to the respective cylindrical electrodes so that the electrostatic lens becomes a predetermined non-afocal system shifted from the afocal condition, and the operation mode can be switched between a mode for putting priority on the mass-resolving power and a mode for putting priority on the sensitivity by changing the setting of the voltages applied from the voltage supplier to the cylindrical electrodes.

With this configuration, it is possible to easily switch the system between an operation mode with a high level of mass-resolving power and a certain level of measurement sensitivity and an operation mode with a high level of sensitivity and a certain level of mass-resolving power by merely changing the applied voltages without making mechanical changes, such as exchanging or mechanically moving an ion optical element.

Since the electrostatic lens is composed of a plurality of cylindrical electrodes, the aperture of the restrictor is also normally shaped like a circle which is rotationally symmetrical around the ion-optical axis. This design eliminates the necessity of the rotational positioning the restrictor around the ion-optical axis in the process of attaching the restrictor, making the assembly easier. The restrictor itself can also be easily produced.

In the case of accelerating ions by an orthogonal acceleration unit and sending them into a time-of-flight analysis space, the spatial spread of the ions in the accelerating direction (the time-of-flight analysis direction) should preferably be as narrow as possible. However, in a direction orthogonal to the accelerating direction, the ions should preferably be distributed to some extent, because it will increase the amount of ions to be eventually used in the analysis and advantageously improve the sensitivity. Thus, the preferable state of the spatial distribution of the ions is different between the two directions extending along the two mutually orthogonal axes on a plane orthogonal to the ion-optical axis. Therefore, in terms of performance, the aperture of the restrictor should preferably be shaped like a rectangle or ellipse whose center is located on the ion-optical axis. That is to say, the aperture size should preferably be different between the two directions extending along the two mutually orthogonal axes.

An ion-entrance aperture formed in the front-end portion of a first cylindrical electrode which is located closest to the inlet side among the plurality of cylindrical electrodes constituting the electrostatic lens is also normally circular in shape. However, due to the previously described reason, this ion-entrance aperture should also preferably be rectangular or elliptical in shape.

In the time-of-flight mass spectrometer according to the present invention, the front-end portion of the first cylindrical electrode which is located closest to the inlet side among the cylindrical electrodes constituting the electrostatic lens may preferably be shaped like a skimmer having an ion-entrance aperture formed at its apex. This design helps ions flying toward the electrostatic lens to be accelerated toward and gathered at the apex of the skimmer when entering the electrostatic lens, whereby the initial angular spread of the ions passing through the ion-entrance aperture will be reduced.

In one mode of the time-of-flight mass spectrometer according to the present invention, the electrostatic lens is a symmetrical arrangement in which the distance between the object point and the center of the first-stage virtual convex lens formed under the condition that the electrostatic lens is driven so as to be an afocal system is equal to the distance between the image point and the center of the second-stage virtual convex lens formed under the same condition.

Such a symmetrical arrangement is advantageous, for example, in that the voltage adjustment is easy because the same voltage is applied to both the cylindrical electrodes constituting the first-stage virtual convex lens and those constituting the second-stage virtual convex lens.

In another mode of the time-of-flight mass spectrometer according to the present invention, the electrostatic lens is an asymmetrical arrangement in which the distance between the object point and the center of the first-stage virtual convex lens formed under the condition that the electrostatic lens is driven so as to be an afocal system is different from the distance between the image point and the center of the second-stage virtual convex lens formed under the same condition.

In the case of using such an electrostatic lens in an orthogonal acceleration TOFMS, the image point must be located in the vicinity of the center of the orthogonal acceleration unit, and therefore, it is necessary to ensure an adequate distance from the center of the second-stage virtual convex lens to the image point. If the aforementioned symmetrical arrangement is used, an increase in the distance from the center of the second-stage virtual convex lens to the image point requires a corresponding increase in the distance from the object point to the center of the first-stage virtual convex lens, making the entire electrostatic lens longer. By contrast, the asymmetrical arrangement is advantageous for making the entire electrostatic lens shorter, because it is possible to ensure a long distance between the image point and the center of the second-stage virtual convex lens while using a short distance between the object point and the center of the first-stage virtual convex lens.

In the time-of-flight mass spectrometer according to the present invention, the voltage supplier may apply voltages to the cylindrical electrodes so that the speed of the ions changes before and after the ions pass through the electrostatic lens. If the ions entering the electrostatic lens have an excessive amount of energy, the ions can be decelerated (i.e. their energy can be lowered) during their passage through the electrostatic lens and then sent into the orthogonal acceleration unit. This operation has the effect of reducing the initial energy Ez in the time-of-flight analysis direction of the ions to be accelerated by the orthogonal acceleration unit.

In the time-of-flight mass spectrometer according to the present invention, there is no specific restriction on the type of components to be placed before the electrostatic lens in order to send ions into the lens.

For example, the system may be configured so that ions generated by and ejected from an ion source are directly introduced into the electrostatic lens, or alternatively, another ion guide may be provided between the ion source and the electrostatic lens. A collision cell for promoting dissociation of ions may be placed before the electrostatic lens so that fragment ions produced by the collision cell are introduced into the electrostatic lens. It is also possible to provide an ion trap capable of holding ions before the electrostatic lens so that the ions ejected from the ion trap are introduced into the electrostatic lens. The ion trap may be a linear ion trap or a three-dimensional quadrupole ion trap.

Effect of the Invention

With the time-of-flight mass spectrometer according to the present invention, as compared to conventional systems, it is possible to reduce the angular distribution of the ions entering the orthogonal acceleration unit while ensuring an adequate amount of ions to be introduced into the orthogonal acceleration unit. As a result, a high level of mass-resolving power is achieved while preventing a significant deterioration of the measurement sensitivity.

In the time-of-flight mass spectrometer according to the mode of the present invention in which a non-afocal operation can be chosen, users can easily and conveniently switch the system between the "high mass-resolution measurement mode" with priority put on the mass-resolving power and the "high sensitivity measurement mode" with priority put on the measurement sensitivity. Thus, an appropriate analysis can be performed depending on the purpose of the analysis, the kind of sample or other factors.

BEST MODE FOR CARRYING OUT THE INVENTION

Figure 1:
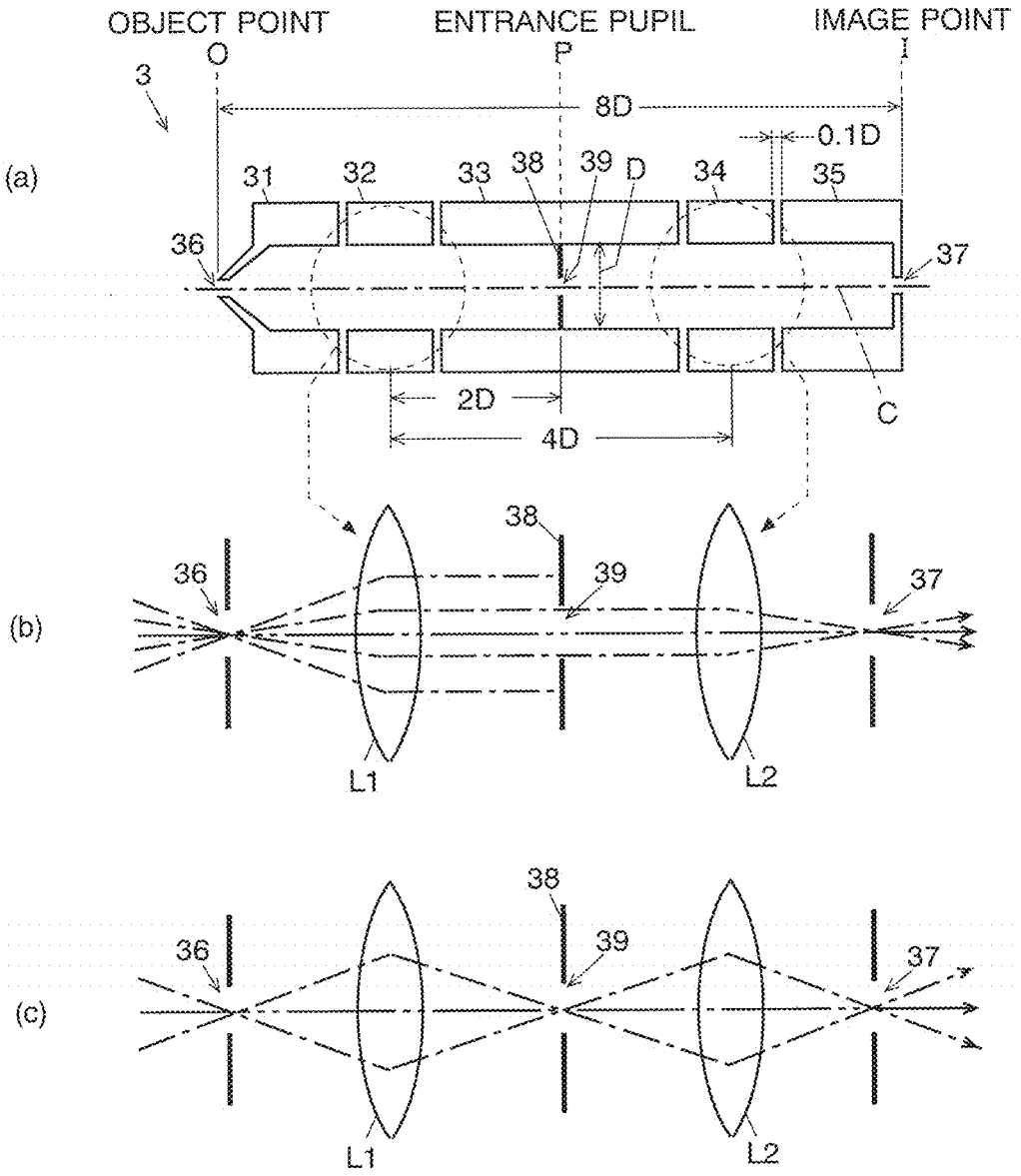
FIG. 1 shows (a) a schematic configuration diagram, (b) and (c) its optical equivalent configuration diagrams of an ion-injecting optical system in an orthogonal acceleration TOFMS as one embodiment of the present invention.
Figure 2:
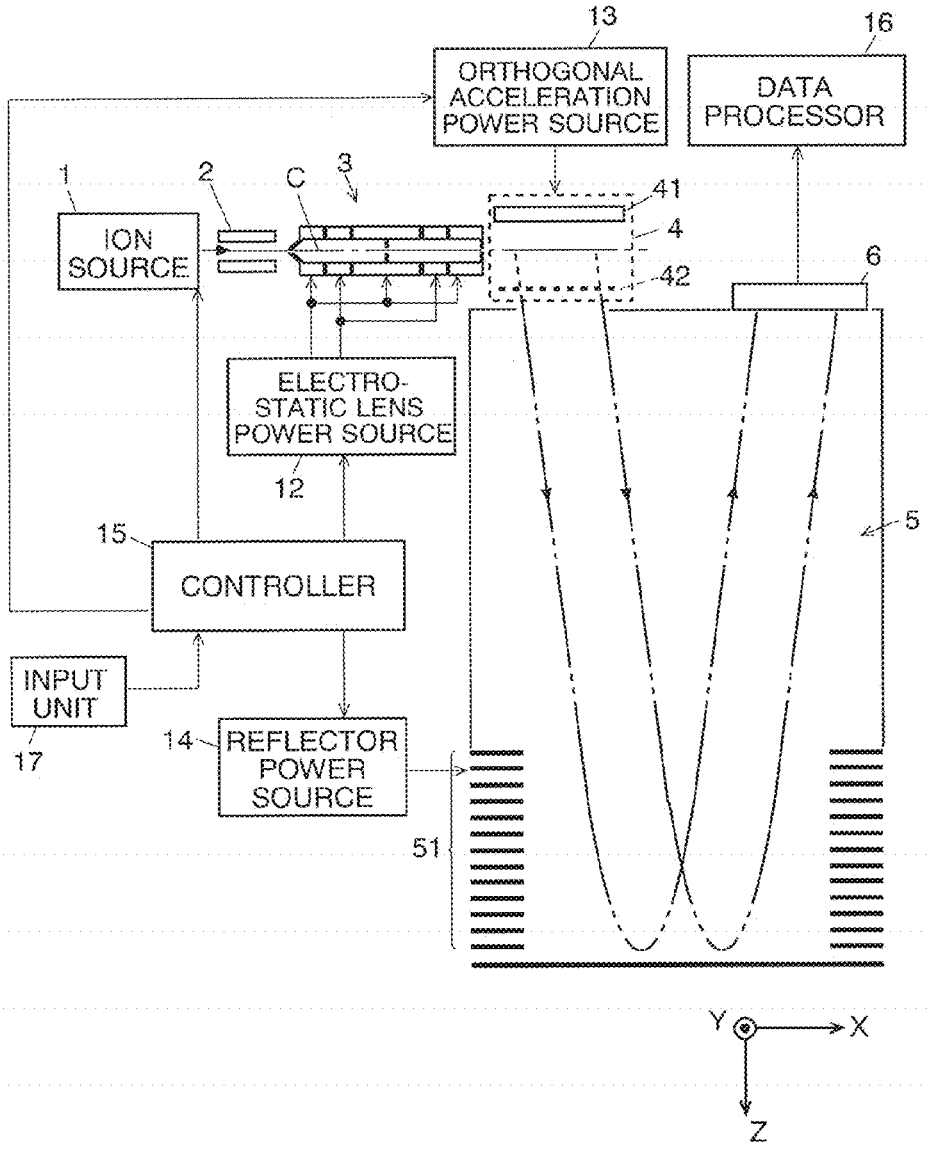
FIG. 2 is an overall configuration diagram of the orthogonal acceleration TOFMS which is the present embodiment.

An orthogonal acceleration TOFMS as one embodiment of the present invention is hereinafter described with reference to the attached drawings. FIG. 2 is an overall configuration diagram of the orthogonal acceleration TOFMS of the present embodiment. FIG. 1 shows a schematic configuration diagram (a) and its optical equivalent configuration diagrams (b) and (c) of an ion-injecting optical system of the orthogonal acceleration TOFMS.

The orthogonal acceleration TOFMS according to the present embodiment includes: an ion source 1 for ionizing a target sample; a TOF analyzer 5 with a reflector 51; an orthogonal acceleration unit 4 for accelerating ions and sending them into the TOF analyzer 5; an electrostatic lens 3 for sending ions ejected from the ion source 1 into the orthogonal acceleration unit 4; a detector 6 for detecting ions which have travelled through the flight space of the TOF analyzer 5; a data processor 16 for processing data obtained with the detector 6 to create, for example, a mass spectrum; an electrostatic lens power source 12 for applying predetermined voltages to the respective electrodes constituting the electrostatic lens 3; an orthogonal acceleration power source 13 for applying a predetermined voltage to the electrodes 41 and 42 included in the orthogonal acceleration unit 4; a reflector power source 14 for applying a predetermined voltage to the reflector 51; a controller 15 for controlling the operations of each component; and an input unit 17 for allowing users to specify analysis conditions or the like.

The ionization method used in the ion source 1 is not limited to any specific one. For liquid samples, an atmospheric pressure method is used, such as electrospray ionization (ESI) or atmospheric pressure chemical ionization (APCI). For solid samples, a matrix-assisted laser desorption ionization (MALDI) or similar method is used.

The basic operation of the present orthogonal acceleration TOFMS is as follows: Various kinds of ions generated in the ion source 1 (e.g. by ESI) are introduced through an appropriate type of ion guide 2 into the electrostatic lens 3, and further introduced through the electrostatic lens 3 into the orthogonal acceleration unit 4. At the point in time when the ions are introduced into the orthogonal acceleration unit 4, no accelerating electric field is present within the orthogonal acceleration unit 4. When an adequate amount of ions have been introduced, a predetermined voltage is applied from the orthogonal acceleration power source 13 to the plate electrode 41 and the mesh electrode 42 to create an accelerating electric field. Due to the effect of this electric field, the ions are given an amount of kinetic energy and sent into the flight space of the TOF analyzer 5. As shown in FIG. 2, an ion which has begun flying from the accelerating region of the orthogonal acceleration unit 4 is made to turn around by an electric field created by the voltage applied from the reflector power source 14 to the reflector 51, to eventually arrive at the detector 6. The detector 6 produces a detection signal corresponding to the amount of incoming ions. The data processor 16 forms a time-of-flight spectrum from the detection signal, and converts the time of flight into mass-to-charge ratio to obtain a mass spectrum.

As shown in FIG. 1(*a*), the electrostatic lens 3 consists of five cylindrical electrodes 31-35 arrayed along the ion-optical axis C. In the front-end portion of the first cylindrical electrode 31, a skimmer having an apex located on the ion-optical axis C is integrally formed, with a circular ion-entrance aperture 36 bored in the apex. The position of this ion-entrance aperture 36 corresponds to the object point O of the electrostatic lens 3, and the aperture size of this ion-entrance aperture 36 determines the spatial extent of the object point O. It should be noted that, if the gas pressure inside the electrostatic lens 3 is high (the degree of vacuum is low), the electrostatic lens 3 will not function as simulated due to the collision of the ions with the residual gas. In general, the space before the electrostatic lens 3 is where an ion source, collision cell or similar system component having a relatively high gas pressure is provided, and it is necessary to prevent the gas from flowing into the electrostatic lens 3. For this reason, the front-end portion of the first cylindrical electrode 31 in the present example is shaped like a skimmer and the ion-entrance aperture 36 is provided at the apex of the skimmer. However, it is not always necessary to adopt the skimmer-like shape.

On the other hand, in the rear-edge portion of the last cylindrical electrode 35, a plate part, in which a circular ion-exit aperture 37 is bored on the ion-optical axis C, is integrally formed. Furthermore, an aperture plate 38, in which a circular restriction aperture 39 of a predetermined size is formed on the ion-optical axis C, is attached to the inner circumferential wall of the cylindrical electrode 33, which is the longest electrode in the direction of the ion-optical axis C. With D denoting the inner diameter of the cylindrical electrodes 31-35, the gap between the neighboring cylindrical electrodes 31-35 is G=0.1 D, the total length in the direction of the ion-optical axis C is 8 D, and the distance between the center of the second cylindrical electrode 32 and that of the fourth cylindrical electrode 34 is 4 D.

As shown in FIG. 2, a common voltage V1 is applied to the first, third and last cylindrical electrodes 31, 33 and 35, while another common voltage V2, which is different from the voltage V1, is applied to the second and fourth cylindrical electrodes 32 and 34. The second and fourth cylindrical electrodes 32 and 34 are adequately shorter in the direction of the ion-optical axis C than the third cylindrical electrode 33 located between them. Therefore, when the aforementioned voltages are applied to the respective cylindrical electrodes 31-35, a virtual convex lens L1 is created by a DC electric field formed by the rear-edge portion of the first cylindrical electrode 31 and the front-end portion of the third cylindrical electrode 33, with the second cylindrical electrode 32 at the center (this lens is hereinafter called the "first-stage virtual convex lens"), and another virtual convex lens L2 is created by a DC electric field formed by the rear-edge portion of the third cylindrical electrode 33 and the front-end portion of the last cylindrical electrode 35, with the fourth cylindrical electrode 34 at the center (this lens is hereinafter called the "second-stage virtual convex lens"). As in this case, if the same voltage is commonly applied to the cylindrical electrodes 31, 33 and 35, the characteristics of the two virtual convex lenses L1 and L2 are determined by the voltage applied to the cylindrical electrodes 32 and 34.

In the present case, since the structure and size of the section from the rear-edge portion of the first cylindrical electrode 31 to the center of the cylindrical electrode 33 are the same as those of the section from the center of the cylindrical electrode 33 to the front-end portion of the last cylindrical electrode 35, and since the common voltage V2 is applied to both the cylindrical electrodes 32 and 34, the first-stage virtual convex lens L1 and the second-stage virtual convex lens L2 have the same characteristics and the same focal length. Therefore, the image point I of the electrostatic lens 3 is located at the ion-exit aperture 37. Since both the distance between the center of the cylindrical electrode 32 and that of the cylindrical electrode 33, and the distance between the center of the cylindrical electrode 34 and that of the cylindrical electrode 33, are 2 D, the focal planes of the two virtual convex lenses L1 and L2 coincide with each other at the center of the cylindrical electrode 33, i.e. at the position where the aperture plate 38 is located, when a certain voltage is applied to the cylindrical electrodes 32 and 34. Thus, the electrostatic lens 3 becomes a system which satisfies an afocal condition, i.e. an afocal system. Therefore, the restriction aperture 39 formed in the aperture plate 38 functions as the entrance pupil of the electrostatic lens 3.

Figure 11:
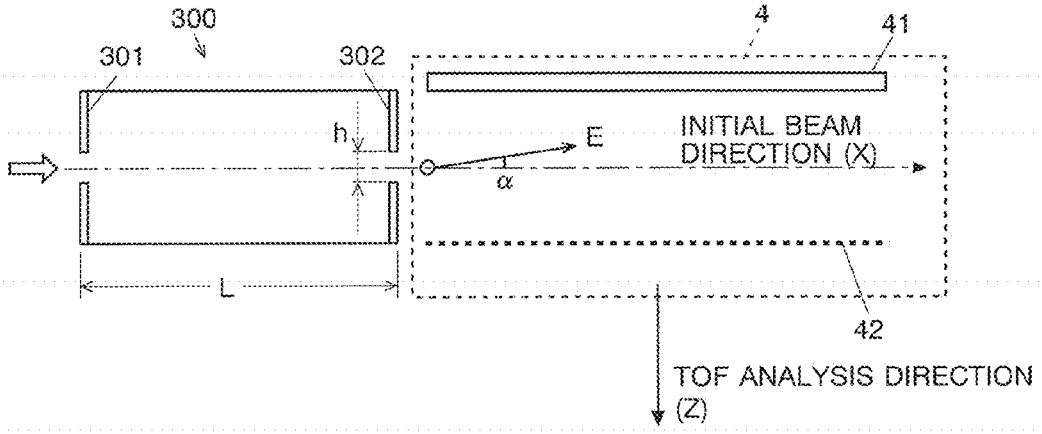
FIG. 11 is a schematic configuration diagram of an orthogonal acceleration unit and an ion-injecting optical system located before the same unit in a conventional orthogonal acceleration TOFMS.

In an afocal system, as shown in FIG. 1(*b*), an ion beam which has entered the system in a direction that intersects the ion-optical axis C at a predetermined angle to the ion-optical axis C at the ion-entrance aperture 36 is bent by the first-stage virtual convex lens L1 so as to be parallel to the ion-optical axis C, and subsequently, is once more bent by the second-stage virtual convex lens L2 so as to intersect the ion-optical axis C at a predetermined angle to the ion-optical axis C at the ion-exit aperture 37. Any beam having an incident angle equal to or greater than a predetermined angle is blocked by the aperture plate 38 located at the focal plane. Therefore, the angular spread of the exit beam is determined by the size (or diameter) of the restriction aperture 39. Under the condition of the same diameter of the ion-exit aperture 37 and the same angular spread of the exit beam, if the electrostatic lens 3 consisting of the cylindrical electrodes 31-35 in the present embodiment is compared with the beam-restricting mechanism shown in FIG. 11, the configuration of the present embodiment allows a larger amount of ion beam to pass through as a result of the previously described effect of the first-stage virtual convex lens L1 and the second-stage virtual convex lens L2. Therefore, the previously described configuration of the electrostatic lens 3 can send a larger amount of ions into the orthogonal acceleration unit 4 while suppressing the spatial distribution and the angular spread of the exit beam, which is advantageous for improving the measurement sensitivity.

On the other hand, when a voltage which is different from the voltage that satisfies the afocal condition is applied to the second and fourth cylindrical electrodes 32 and 34, the electrostatic lens 3 becomes a non-afocal system, which can be tuned so that the largest amount of ions will pass through the restriction aperture 39 when predetermined voltages are applied. In general, this is the situation in which the characteristics of the virtual convex lenses L1 and L2 are respectively adjusted so that an ion beam which has entered the system in a direction that intersects the ion-optical axis C at a predetermined angle to the ion-optical axis C at the ion-entrance aperture 36 is focused on the location point of the aperture plate 38 (and gathered on the ion-optical axis C), as shown in FIG. 1(*c*). In this situation, the largest amount of ions is sent into the orthogonal acceleration unit 4 and a high level of measurement sensitivity is achieved. However, the mass-resolving power is to some extent sacrificed due to the increased angular spread of the exit beam.

The orthogonal acceleration TOFMS of the present embodiment has two measurement modes prepared beforehand, i.e. a "high-resolution measurement mode", in which voltages that satisfy an afocal condition as shown in FIG. 1(*b*) are applied from the electrostatic lens power source 12 to the electrostatic lens 3, and a "high-sensitivity measurement mode", in which voltages that create a non-afocal system for allowing the largest possible amount of ions to pass through as shown in FIG. 1(*c*) are applied from the electrostatic lens power source 12 to the electrostatic lens 3. When performing an analysis, users can select one of the measurement modes through the input unit 17. The values of the voltages to be applied to the electrostatic lens 3 in each of the measurement modes can be previously determined by simulation or preliminary experiments. When the "high-resolution measurement mode" is selected, the measurement can be performed with high mass-resolving power at a slight sacrifice of the sensitivity. This mode is suitable for a high-accuracy measurement of a substance which is contained in comparatively large quantity. When the "high-sensitivity measurement mode" is selected, the measurement can be performed with high sensitivity at the sacrifice of the mass-resolving power. This mode is suitable for the measurement of a substance which is contained in small quantity.

Figure 3:
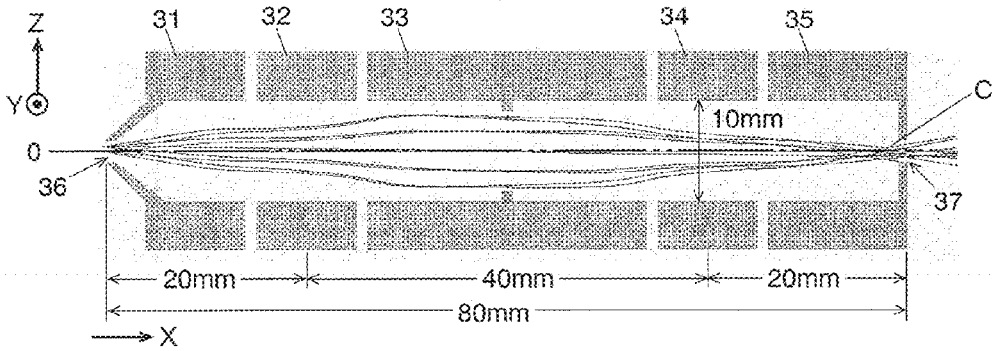
FIG. 3 is a diagram showing the result of a simulation of ion trajectories under an afocal condition in the ion-injecting optical system of the present embodiment.

A simulation performed for confirming the superiority of the electrostatic lens 3 which corresponds to the ion-injecting optical system in the present invention is hereinafter described. In the simulation, the shapes and sizes of the cylindrical electrodes 31-35 of the electrostatic lens 3 were set as shown in FIG. 3. The inner diameter D of the cylindrical electrodes 31-35 was 10 mm.

Initially, under the condition that the electrostatic lens 3 satisfies the afocal condition, the ion trajectories were calculated for two values of the release point of the ions (i.e. the object point O) on the ion-entrance aperture 36: Z=0 mm (on the ion-optical axis C) and Z=0.5 mm, as well as for five values of the incident angle of the ion beam (i.e. the angle with respect to the ion-optical axis C): −10, −5, 0, 5 and 10 degrees. FIG. 3 shows the calculation result. The ion trajectories shown in FIG. 3 demonstrate that, by placing a restriction aperture on the common focal plane, it is possible to effectively restrict the angular spread of the ion beam with a negligible influence on the spatial spread of the ion beam.

Next, the ion trajectories were simulated under the afocal condition as well as under the non-afocal condition (the highest signal intensity), with the size of the restriction aperture 39 set at a predetermined value. As the simulation conditions, it was assumed that 1000 ions (m/z 1000) with an initial energy of 10 eV were arranged at the ion-entrance aperture 36, with the initial distribution of the spatial position of the ions being σ=0.25 mm in both the Y and Z directions, and the initial distribution of the incident angle (the angle to the X direction) of the ions being σ=5 degrees (see FIG. 4(*a*)). Under these conditions, the target was set at suppressing the angular spread of the ion beam to ±2 degrees or smaller at the ion-exit aperture 37, and the size of the restriction aperture 39 was set at ϕ=1.6 mm with reference to FIG. 3.

Figure 4:
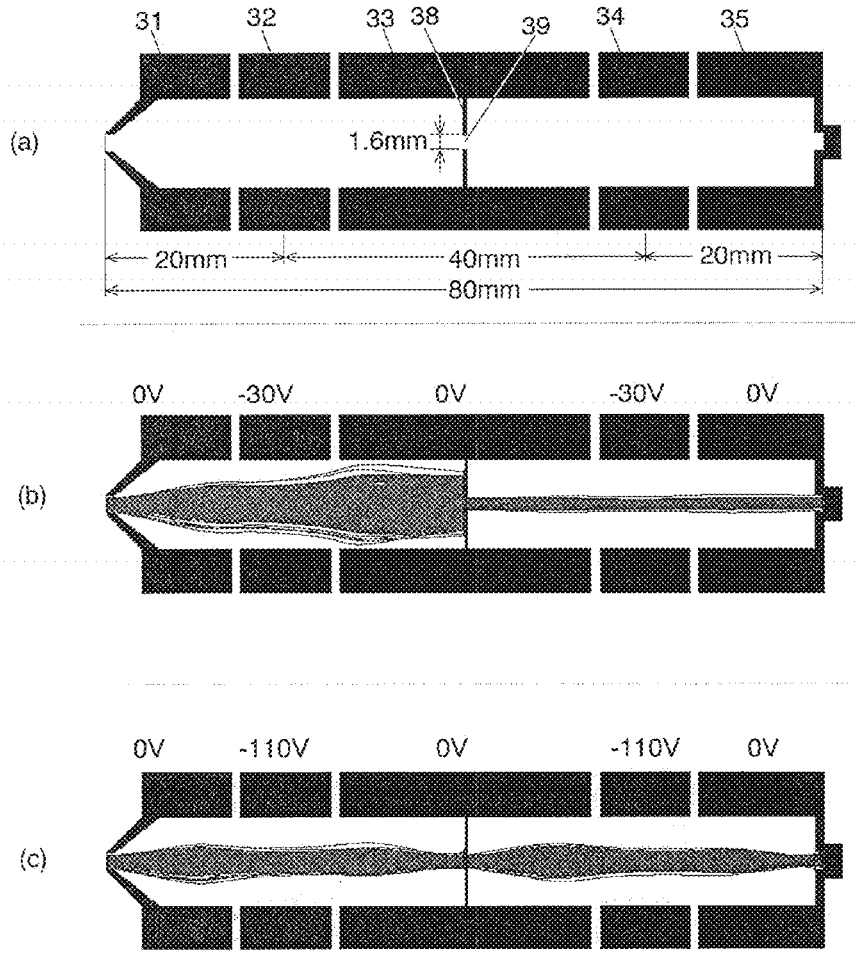
FIG. 4 shows (a) a diagram showing the electrode shape used in a simulation of the ion-injecting optical system of the present embodiment, (b) a graphic showing the result of the simulation of the ion trajectories in a high-resolution measurement mode (under an afocal condition), and (c) a graphic showing the result of the simulation of the ion trajectories in a high-sensitivity measurement mode (under a non-afocal condition).
Figure 5:
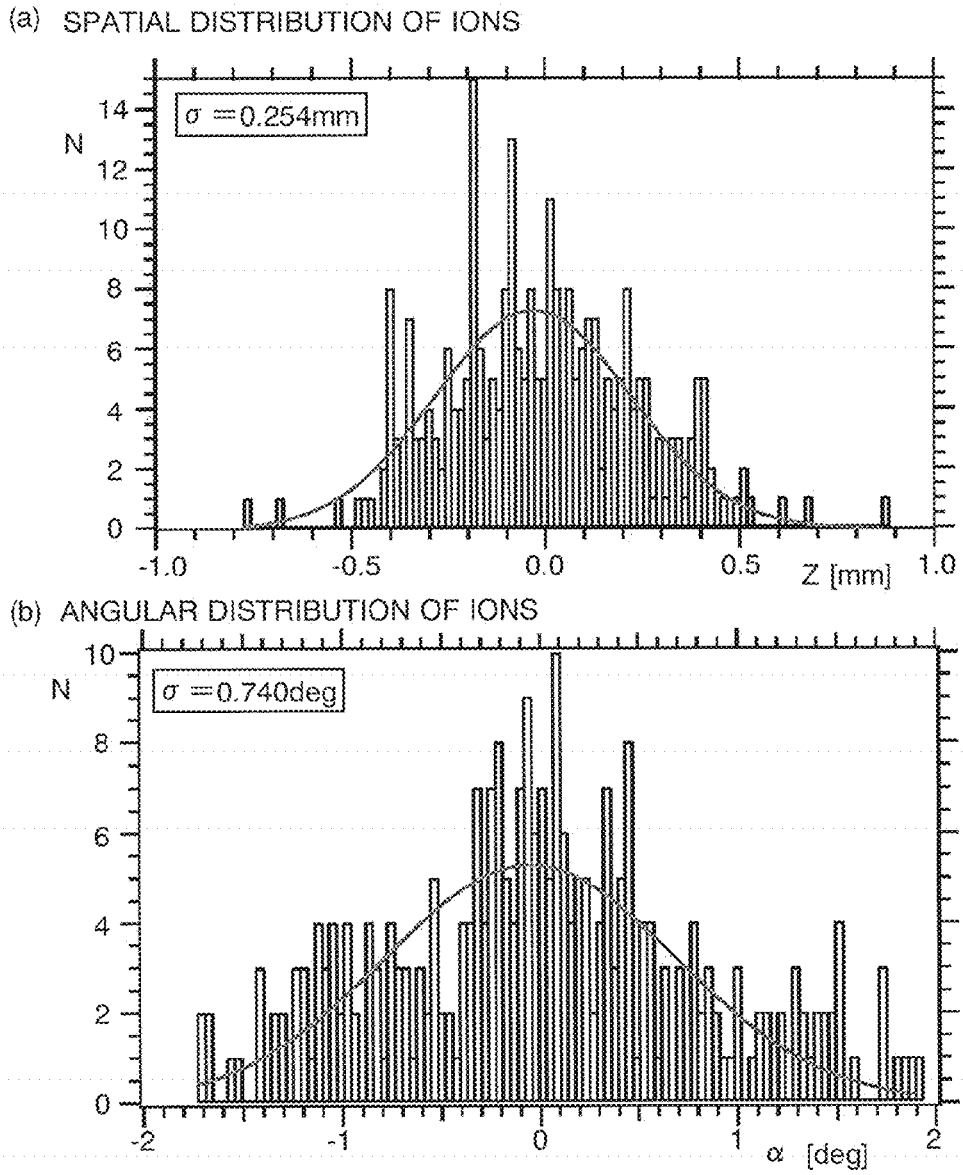
FIG. 5 shows (a) a chart showing the result of a simulation of the spatial distribution of the ions after a passage through the lens in the high-resolution measurement mode (under an afocal condition), and (b) a chart showing the result of a simulation of the angular distribution of the ions.

The result of the calculation of the ion trajectories under the afocal condition is shown in FIG. 4(*b*). Specifically, the voltage V1 applied to the cylindrical electrodes 31, 33 and 35 was 0 V, and the voltage V2 applied to the cylindrical electrodes 32 and 34 was −30 V. The number of ions which could pass through the electrostatic lens 3 was 275 out of 1000. FIG. 5 shows histograms of the Z-direction spatial distribution (a) and the angular distribution (b) of the ions entering the detector placed at the ion-exit aperture 37 (i.e. at the image point I). These histograms demonstrate that the spatial distribution at the ion-exit aperture 37 is maintained approximately as small as the value at the ion-entrance aperture 36 (σ=0.25 mm), while the angular spread is limited within ±2 degrees.

Figure 6:
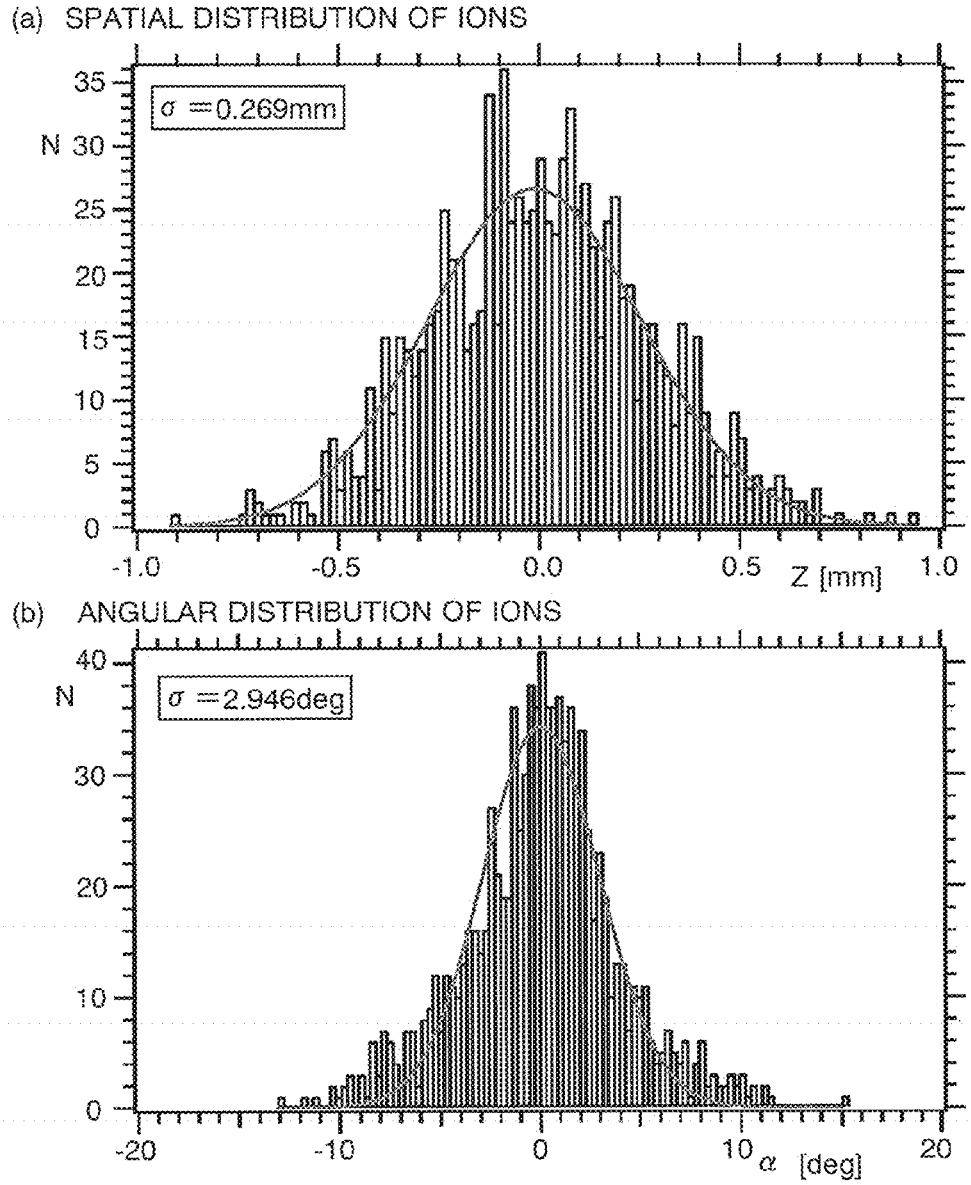
FIG. 6 shows (a) a chart showing the result of a simulation of the spatial distribution of the ions after passage through the lens in the high-sensitivity measurement mode (under a non-afocal condition), and (b) a chart showing the result of a simulation of the angular distribution of the ions.

For the same initial distribution of the ions, another trajectory calculation was similarly performed in which the voltages applied to the electrostatic lens 3 were set so as to make the lens operate as a non-afocal system having the highest ion-passage efficiency (i.e. the "high-sensitivity measurement mode"). Specifically, the voltage V1 applied to the cylindrical electrodes 31, 33 and 35 was 0 V, and the voltage V2 applied to the cylindrical electrodes 32 and 34 was −110 V. FIG. 4(*c*) shows the result. As can be seen in FIG. 4(*c*), the ion beam has a beam waist formed at the restriction aperture 39. In this situation, a large amount of ions can pass through (967 out of 1000). FIG. 6 shows histograms of the Z-direction spatial distribution (a) and the angular distribution (b) of the ions entering the detector placed at the ion-exit aperture 37 in the present case. A comparison with FIG. 5 demonstrates that, in the present case, the energy distribution in the direction of TOF ejection is large due to the large angular spread, so that the mass-resolving power deteriorates.

As described thus far, the electrostatic lens 3 in the orthogonal acceleration TOFMS of the present embodiment can be switched between the "high-resolution measurement mode" and the "high-sensitivity measurement mode" by simply changing the voltage applied to the cylindrical electrodes 32 and 34. This switching can be easily achieved by merely changing the voltage between the preset values in the electrostatic lens power source 12, without requiring other operations, such as a mechanical switching or replacement. The mode can be switched even in the middle of the measurement. Therefore, for example, in the case of measuring a target component whose concentration (content) is unknown, it is possible to perform such a measurement in which the "high-sensitivity measurement mode" is initially used at the sacrifice of the mass-resolving power, and subsequently, when it has been found that an adequate level of signal intensity can be obtained without using the high-sensitivity measurement mode, the operation is switched to the "high-resolution measurement mode" so as to obtain a mass spectrum with high mass-resolving power. Naturally, it is also possible to switch the system from the "high-resolution measurement mode" to the "high-sensitivity measurement mode." In the process of switching the system from the "high-resolution measurement mode" to the "high-sensitivity measurement mode" or vice versa, the sensitivity or mass-resolving power can be changed in various ways, such as continuously, stepwise, or discontinuously.

Figure 7:
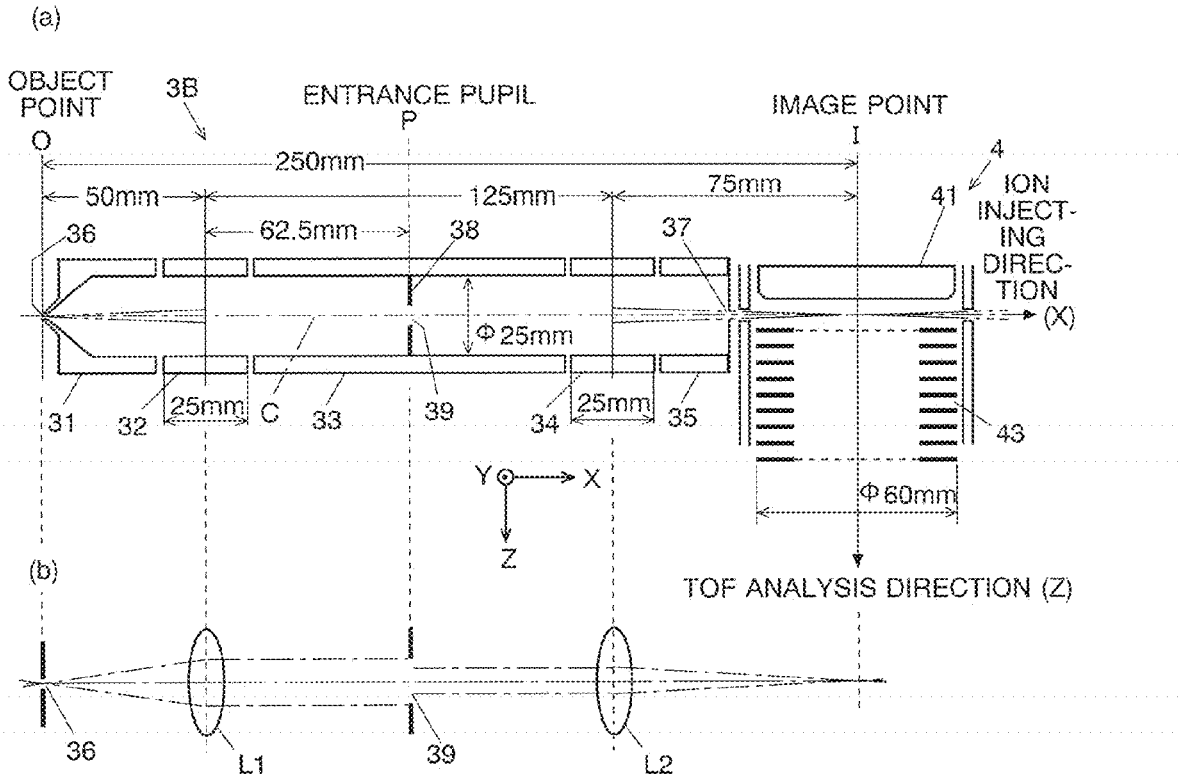
FIG. 7 shows (a) a schematic configuration diagram and (b) an optical equivalent configuration diagram of one example of a more realistic design of an electrostatic lens which is one embodiment of the TOFMS according to the present invention and which satisfies an afocal condition.

Another embodiment, in which an electrostatic lens satisfying an afocal condition is designed in a more realistic form as an ion-injecting optical system for sending ions into the orthogonal acceleration unit, is hereinafter described by means of FIG. 7. FIG. 7(*a*) shows a schematic configuration diagram showing an electrostatic lens 3B and an orthogonal acceleration unit 4 of the present embodiment, and FIG. 7(*b*) an optical equivalent configuration diagram. The components which are identical or correspond to those used in the previous embodiment are denoted by the same numerals for easy understanding of the correspondence relationship.

As already noted, in an electrostatic lens designed as an afocal system, a beam of ions which has departed from the object point O is focused on the image point I and forms an image. Before this electrostatic lens, an ion source 1 may be provided, as shown in FIG. 2, or a collision cell may be provided in the case of an MS/MS mass spectrometer. These types of devices are maintained at high gas pressure (low degree of vacuum). On the other hand, for an afocal electrostatic lens to operate as designed, it is necessary to maintain the gas pressure inside the electrostatic lens, i.e. the density of the residual gas molecules, at adequately low levels. Naturally, the orthogonal acceleration unit 4 and the TOF analyzer 5 located behind the lens also need to be maintained at adequately low levels of gas pressure (high degrees of vacuum).

Accordingly, in the electrostatic lens 3B of the present embodiment, the ion-entrance aperture 36 of the first cylindrical electrode 31 is made to be as small as ϕ1.6 mm to lower the gas conductance, and furthermore, the front-end portion of the first cylindrical electrode 31 is shaped like a skimmer to accelerate ions and gather them at the pointed tip of the skimmer so as to reduce the initial angular distribution of the ions passing through the ion-injection aperture 36. If the initial angular distribution of the ions is excessively large, one or more lenses may be additionally provided before the electrostatic lens 3B so as to reduce the initial angle of the ions and thereby avoid a decrease in the ion intensity.

In the configuration shown in FIG. 1, the image point I is located at the ion-exit aperture 37 of the last cylindrical electrode 35 of the electrostatic lens 3. However, in order to reduce the spatial distribution of the ions in the Z-direction during the acceleration of the ions in the orthogonal acceleration unit 4, the image point I should preferably be located at the center of the orthogonal acceleration unit 4, as shown in FIG. 7(*a*). Furthermore, since the orthogonal acceleration unit 4 normally includes a number of ring-shaped guard-ring electrodes 43 as shown in FIG. 7(*a*), the orthogonal acceleration unit 4 inevitably has a non-negligible diameter in the X-direction, which is normally tens of millimeters. Therefore, it is necessary to use, as the second-stage virtual convex lens L2, a lens having a long distance from its center to the image point I. Meanwhile, the total length of the electrostatic lens (the distance from the object point O to the image point I) should preferably be as short as possible to make the system smaller. Given these requirements, in the present embodiment, the inner diameter of the cylindrical electrodes 31-35 is increased to D=25 mm, and an asymmetrical arrangement is adopted, with the distance from the object point O to the center of the first-stage virtual convex lens L1 (the center of the cylindrical electrode 32) being 50 mm (=2 D) and the distance from the center of the second-stage virtual convex lens L2 (the center of the cylindrical electrode 34) to the image point I being 75 mm (=3 D). It should be noted that the electrostatic lens 3 shown in FIG. 3 is a symmetrical arrangement in which the distance from the object point O to the center of the first-stage virtual convex lens L1 is equal to the distance from the center of the second-stage virtual convex lens L2 to the image point I. An asymmetrical arrangement, as in the present embodiment, is suitable for ensuring the largest possible distance from the center of the second-stage virtual convex lens L2 to the center of the orthogonal acceleration unit 4 while maintaining the entire electrostatic lens 3B as short as possible. In the system shown in FIG. 7(*a*), the distance between the centers of the two virtual convex lenses L1 and L2 is 125 mm (=5 D), and the entire length is 250 mm (=10 D).

In general, the requirements to be satisfied by an ion-injecting optical system for the previously described orthogonal acceleration unit 4 are as follows:

(1) Limitation of angular distribution: To achieve a high mass-resolving power, the angular distribution of the ions in the time-of-flight analysis direction (Z-direction) must be extremely reduced. By contrast, the angular distribution of the ions in the Y-direction, which is orthogonal to both the X-direction (the incident direction of the ions) and the Z-direction, does not need to be so strictly limited as in the Z-direction. Actually, in order to increase the amount of ions arriving at the detector and thereby increase the signal intensity, it is preferable to relax the angular limitation in the Y-direction as long as the influence on the distribution of the ions arriving at the detector or on the mass-resolving power is within an allowable range. Taking these factors into account, the electrostatic lens should preferably be constructed so that the angular dispersions in the Y and Z directions can be independently set.

(2) Limitation of positional distribution: A positional (spatial) distribution of the ions in the Z-direction causes an energy spread of an ion packet to be subjected to mass spectrometry, and therefore, should preferably be as small as possible. By contrast, the spatial distribution of the ions in the Y-direction does not need to be so strictly limited as in the Z-direction. Actually, in order to increase the signal intensity, it is preferable to relax the limitation of the spatial distribution of the ions in the Y-direction within an allowable range, as in the case of the angular dispersion. Accordingly, the electrostatic lens should preferably be constructed so that the spatial dispersions in the Y and Z directions can also be independently set.

To enable the independent setting of the angular distributions of the ions in the Y and Z directions, the restriction aperture 39 of the aperture plate 38 attached to the inner circumference of the central cylindrical electrode 33 may have a shape whose length in the Y direction is different from its length in the Z direction. A specific example is a rectangular or elliptical aperture.

A simulation performed for confirming the effect of using a rectangular or elliptical restriction aperture 39 instead of the circular one is hereinafter described. The configuration assumed in the simulation had the electrode arrangement as shown in FIG. 7(*a*) with the restriction aperture 39 having a rectangular shape measuring 9 mm in the Y direction and 3.4 mm in the Z direction. Ion trajectories were calculated under the condition that a certain kind of ions (with m/z 1000 and an initial energy of 26 eV) were released from the object point O at various initial angles (the angle from the X-direction, or the ion-optical axis C) within a predetermined range.

Figure 8:
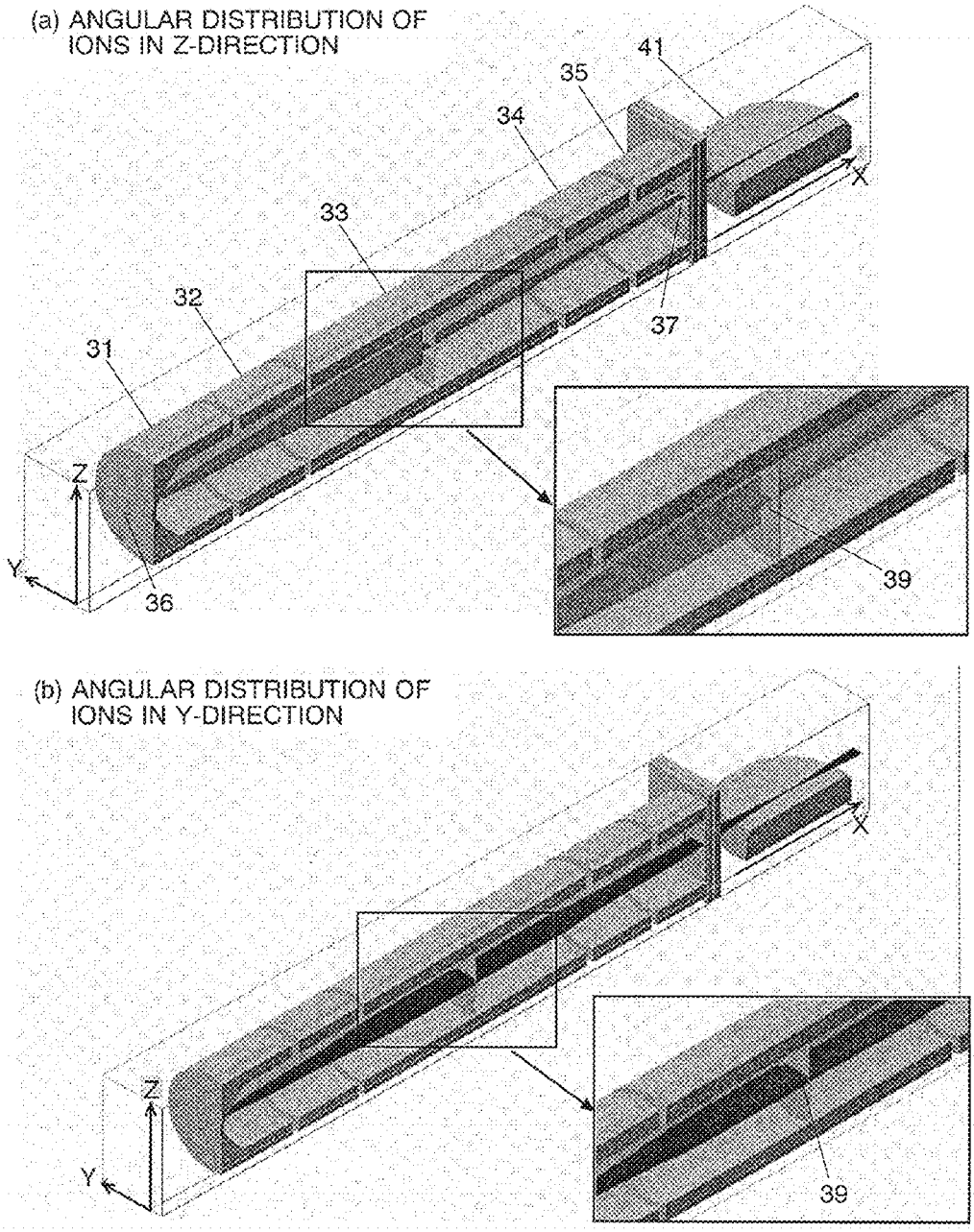
FIG. 8 shows graphics showing the result of a simulation of ion trajectories in which a restrictor having a rectangular aperture was used in the configuration shown in FIG. 7.

FIG. 8 shows perspective sectional views illustrating the ion trajectories under an afocal condition with the voltages applied to the five cylindrical electrodes 31-35 being 0 V, −61 V, 0 V, −61 V and 0 V in order from the entrance side. Each of these views shows 101 ion trajectories calculated for different initial angles ranging from −5 to 5 degrees in step of 0.1 degrees in the Z-direction (a) or Y-direction (b). It can be understood from these figures that the angular distributions of the ions in the Y and Z directions have been independently set by using the restriction aperture 39 having a rectangular shape elongated in the Y direction. Naturally, the shape of the restriction aperture 39 is not limited to the rectangle. For example, it may be an ellipse whose aspect ratio is not 1:1.

Figure 9:
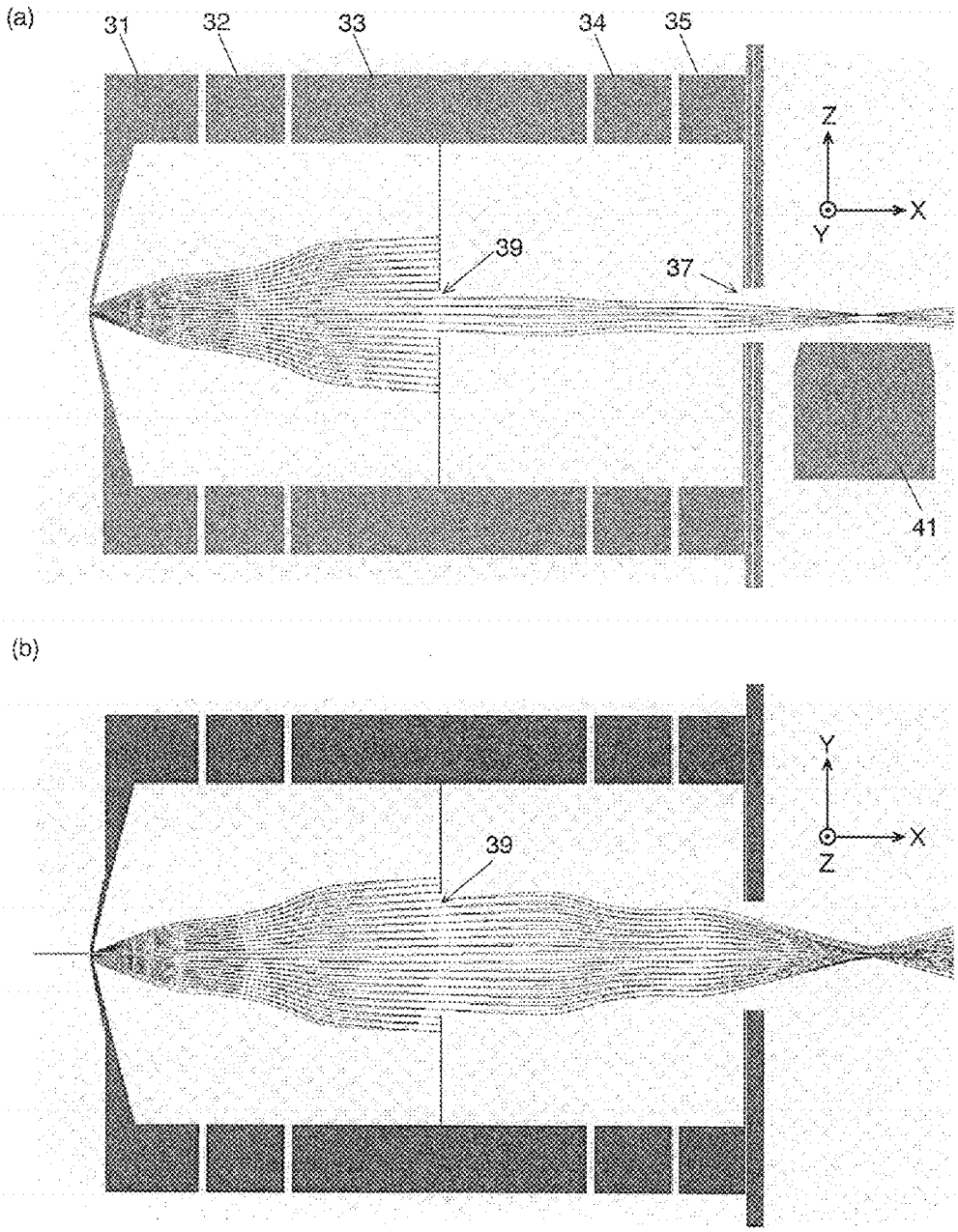
FIG. 9 shows graphics showing the result of a simulation of ion trajectories computed taking into account the initial positional distribution of the ions at the object point in the configuration shown in FIG. 7.

FIG. 9 shows the result of simulations in which the initial positional distribution of the ions at the object point O was also considered. The graphics are vertically stretched so as to clearly show the difference in the ion trajectories depending on the initial position and angle of the ions. Specifically, (a) shows the cases where the initial positions of the ions were Z=0 mm and 0.5 mm, and (b) shows the cases where the initial positions of the ions were Y=0 mm and 0.5 mm. In these drawings, 21 ion trajectories are drawn for each case, with the initial angles ranging from −5 to 5 degrees in steps of 0.5 degrees. These results demonstrate that the restriction aperture 39 discriminates ions only by the difference in their initial angles and not by the difference in their initial positions, thus efficiently limiting the angular distribution of the ions.

The restriction aperture 39 used in the present example can limit the angular distribution of the ions within a range of approximately ±1.5 degrees in the Z-direction and approximately ±4 degrees in the Y-direction. The angular distributions in the Z and Y directions can be independently set by changing the shape (size) of the restriction aperture 39. Therefore, it is possible to improve the sensitivity by relaxing the limitation of the angular distribution of the ions in the Y direction while limiting the angular distribution of the ions in the Z-direction for the sake of a high mass-resolving power.

As can be seen in FIG. 9, the flux (ion flux) which has departed from the entrance (object point O) of the afocal electrostatic lens 3 forms an image at the center of the orthogonal acceleration unit 4 (image point I). Therefore, to further improve the sensitivity, the entrance of the electrostatic lens 3 (i.e. the ion-entrance aperture 36) may also be preferably shaped wider in the Y-direction than in the Z-direction, such as a rectangular or elliptical shape, rather than a circular shape. This design improves the sensitivity without increasing the energy spread of the ion packet from the orthogonal acceleration unit 4.

Figure 10:
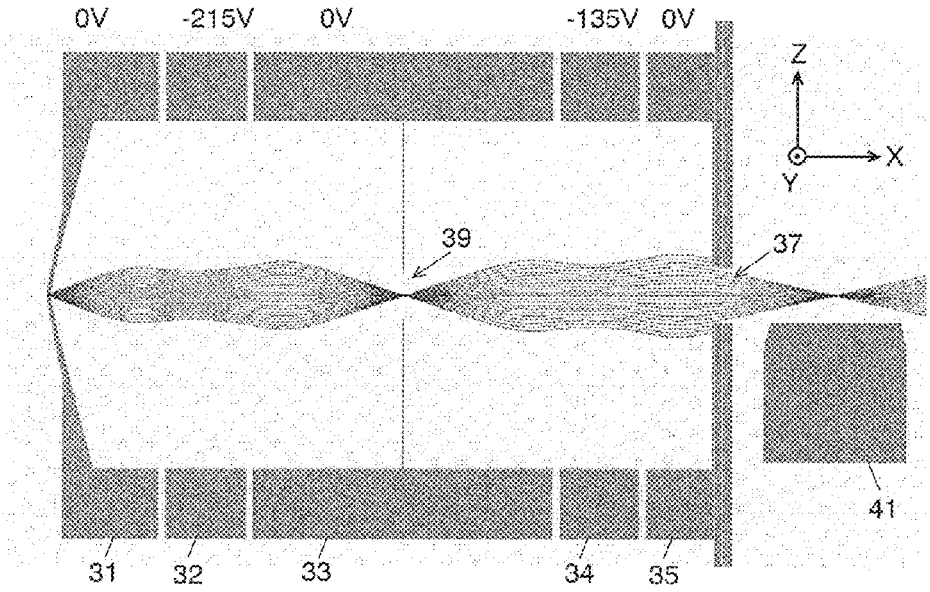
FIG. 10 shows graphics showing the result of a simulation in which the configuration shown in FIG. 7 was operated as a non-afocal system.
Figure 10:
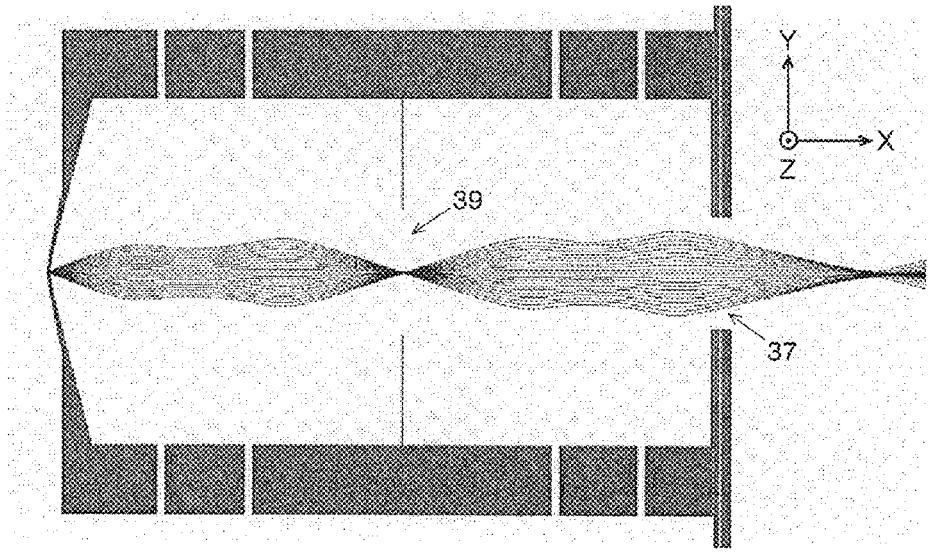

Hereinafter described is the result of a simulation in which the electrostatic lens 3B having the configuration shown in FIG. 7 was operated as a non-afocal system, i.e. in the high-sensitivity measurement mode. FIG. 10 shows the result of the simulation under a non-afocal condition in which the voltage values applied to the respective cylindrical electrodes 31-35 were adjusted so that an image will be formed at the restriction aperture 39 and at the center of the orthogonal acceleration unit 4. The release conditions of the ions, such as their initial angles, were the same as in the simulation of FIG. 9.

Unlike the result of the simulation shown in FIG. 4(*c*) in which the electrostatic lens is a symmetrical arrangement, the voltage values applied to the cylindrical electrodes 32 and 34, which respectively function as the centers of the two virtual convex lenses, are not the same. Specifically, the voltages applied to the five cylindrical electrodes 31-35 were 0 V, −215 V, 0 V, −135 V and 0 V in order from the entrance. FIG. 10 demonstrates that, although the angular distribution of the ions at the center of the orthogonal acceleration unit 4 is somewhat increased, the ions are transported to the orthogonal acceleration unit 4 with almost no loss of the ion intensity. Thus, a larger amount of ions can be subjected to a mass spectrometry to improve the sensitivity.

Any of the previous embodiments are one example of the present invention, and any change, modification or addition appropriately made within the spirit of the present invention will naturally fall within the scope of claims of the present patent application.

For example, although the electrostatic lens 3 or 3B in the previous embodiment was composed of five cylindrical electrodes 31-35, the electrostatic lens may be composed of six or more cylindrical electrodes. For example, in the case where ions are directly injected from the ion source 1 into the electrostatic lens 3 or 3B, the ions are expected to have a considerably large angular distribution. In such a case, it is preferable to additionally provide one or more cylindrical electrodes before the five cylindrical electrodes described in the previous embodiment so as to suppress the angular distribution of the ions.

The aforementioned sizes of the components relevant to the electrostatic lens are mere examples and can appropriately be changed within the spirit and scope of the present invention.

In the TOFMS according to the present invention, the TOF analyzer is not limited to the reflectron type but may be a linear type or other types. The TOFMS may be configured so that ions generated from an ESI ion source or similar ion source 1 are directly introduced into the electrostatic lens 3 or 3B. Alternatively, a linear ion trap or a three-dimensional quadrupole ion trap may be provided between the ion source 1 and the electrostatic lens 3 so that ions are temporarily held in the ion trap and subsequently ejected from the ion trap to be introduced into the electrostatic lens 3 or 3B. It is also possible to adopt the configuration of a Q-TOF system in which the Q1 and Q2 (collision cell) units of a triple quadrupole mass spectrometer are provided before the electrostatic lens. In summary, there is no specific limitation on the components to be provided before the electrostatic lens 3 or 3B.

In the previous embodiment, a common voltage V1 is applied to the first, third and last cylindrical electrodes among the five cylindrical electrodes 31-35 constituting the electrostatic lens, and the entire electrostatic lens 3 or 3B does not cause acceleration or deceleration of the ions (the exit ion has the same amount of the kinetic energy as the incident ion). However, it is also possible to apply separate voltages to the five cylindrical electrodes 31-35 and appropriately adjust the voltage values so as to realize the previously described afocal or non-afocal condition while accelerating or decelerating ions through the entire electrostatic lens. For example, in the case of introducing ions directly from the ion source or introducing them from an ion trap or similar device, the ions may possibly have an excessive amount of kinetic energy. In such a case, the ions can be decelerated to a lower energy level by the electrostatic lens so as to send low-energy ions into the orthogonal acceleration unit. This is effective for suppressing the initial energy of the ions in the TOF analysis direction in the orthogonal acceleration unit.

EXPLANATION OF NUMERALS

1 . . . Ion Source
2 . . . Ion Guide
3, 3B . . . Electrostatic Lens
31-35 . . . Cylindrical Electrode
36 . . . Ion-Entrance Aperture
37 . . . Ion-Exit Aperture
38 . . . Aperture Plate
39 . . . Restriction Aperture
L1, L2 . . . Virtual Convex Lens
4 . . . Orthogonal Acceleration Unit
41 . . . Plate Electrode
42 . . . Mesh Electrode
43 . . . Guard-Ring Electrode
5 . . . TOF Analyzer
51 . . . Reflector
6 . . . Detector
12 . . . Electrostatic Lens Power Source
13 . . . Orthogonal Acceleration Power Source
14 . . . Reflector Power Source
15 . . . Controller
16 . . . Data Processor
17 . . . Input Unit
C . . . Ion-Optical Axis

The invention claimed is:

1. An orthogonal acceleration time-of-flight mass spectrometer comprising:

an orthogonal acceleration unit for accelerating incident ions in a direction orthogonal to an incident axis of the ions; and an ion-injecting optical system for sending the ions into the orthogonal acceleration unit, wherein the ion-injecting optical system comprises:

an electrostatic lens composed of five or more cylindrical electrodes arranged along an ion-optical axis;

a voltage supplier for applying voltages to the respective cylindrical electrodes so that the electrostatic lens becomes an afocal system; and a restrictor having an aperture of a predetermined size on the ion-optical axis, the restrictor being located on a common focal plane of a first-stage virtual convex lens formed by a portion of the five or more cylindrical electrodes and a second-stage virtual convex lens formed by a portion of the five or more cylindrical electrodes under a condition that the voltages for making the electrostatic lens become an afocal system are applied from the voltage supplier, wherein the restrictor sets the angular distribution of ions.

2. The time-of-flight mass spectrometer according to claim 1, wherein the voltage supplier can apply voltages to the respective cylindrical electrodes so that the electrostatic lens becomes a predetermined non-afocal system shifted from an afocal condition, and the operation mode can be switched between a mode for putting priority on a mass-resolving power and a mode for putting priority on a sensitivity by changing a setting of the voltages applied from the voltage supplier to the cylindrical electrodes.

3. The time-of-flight mass spectrometer according to claim 1, wherein the aperture of the restrictor is shaped like a circle which is rotationally symmetrical around the ion-optical axis.

4. The time-of-flight mass spectrometer according to claim 1, wherein the aperture of the restrictor is shaped like a rectangle or ellipse whose center is located on the ion-optical axis.

5. The time-of-flight mass spectrometer according to claim 1, wherein a front-end portion of a first cylindrical electrode which is located closest to an inlet side among the cylindrical electrodes constituting the electrostatic lens is shaped like a skimmer having an ion-entrance aperture formed at an apex.

6. The time-of-flight mass spectrometer according to claim 1, wherein an ion-entrance aperture formed at a front-end portion of a first cylindrical electrode which is located closest to an inlet side among the cylindrical electrodes constituting the electrostatic lens is shaped like a circle.

7. The time-of-flight mass spectrometer according to claim 1, wherein an ion-entrance aperture formed at a front-end portion of a first cylindrical electrode which is located closest to an inlet side among the cylindrical electrodes constituting the electrostatic lens is shaped like a rectangle or ellipse.

8. The time-of-flight mass spectrometer according to claim 1, wherein the electrostatic lens is a symmetrical arrangement in which a distance between an object point and a center of the first-stage virtual convex lens formed under a condition that the electrostatic lens is driven so as to be an afocal system is equal to a distance between an image point and a center of the second-stage virtual convex lens formed under the same condition.

9. The time-of-flight mass spectrometer according to claim 1, wherein the electrostatic lens is an asymmetrical arrangement in which a distance between an object point and a center of the first-stage virtual convex lens formed under a condition that the electrostatic lens is driven so as to be an afocal system is different from a distance between an image point and a center of the second-stage virtual convex lens formed under the same condition.

10. The time-of-flight mass spectrometer according to claim 1, wherein the voltage supplier applies voltages to the respective cylindrical electrodes so that the speed of the ions changes before and after the ions pass through the electrostatic lens.

11. The time-of-flight mass spectrometer according to claim 1, wherein ions generated by and ejected from an ion source are directly introduced into the electrostatic lens.

12. The time-of-flight mass spectrometer according to claim 1, wherein an ion guide is provided between an ion source for generating ions and the electrostatic lens.

13. The time-of-flight mass spectrometer according to claim 1, wherein a collision cell for promoting dissociation of ions is placed before the electrostatic lens, and fragment ions produced by the collision cell are introduced into the electrostatic lens.

14. The time-of-flight mass spectrometer according to claim 1, wherein an ion trap capable of holding ions is placed before the electrostatic lens, and the ions ejected from the ion trap are introduced into the electrostatic lens.

* * * * *